United States Patent [19]

Baehrle et al.

[11] Patent Number: 4,773,476

[45] Date of Patent: Sep. 27, 1988

[54] HEAT PIPE OF ALUMINUM, STEEL OR GRAY CAST IRON

[75] Inventors: Friedrich Baehrle, Kernen-Rommelshausen; Helmut Wulf, Ostfildern; Helmut Kreeb, Meersburg, all of Fed. Rep. of Germany

[73] Assignee: Daimler-Benz Aktiengesellschaft, Stuttgart, Fed. Rep. of Germany

[21] Appl. No.: 933,934

[22] Filed: Nov. 24, 1986

Related U.S. Application Data

[63] Continuation-in-part of Ser. No. 773,867, Sep. 9, 1985, abandoned.

[30] Foreign Application Priority Data

Sep. 15, 1984 [DE] Fed. Rep. of Germany ..... 3433984

[51] Int. Cl.[4] ..... F28D 15/02; F28F 19/06

[52] U.S. Cl. ..... 165/104.27; 165/104.26; 165/133

[58] Field of Search ..... 165/133, 104.26, 104.27

[56] References Cited

FOREIGN PATENT DOCUMENTS

| | | | |
|---|---|---|---|
| 3223496 | 7/1983 | Fed. Rep. of Germany . | |
| 16952 | 2/1978 | Japan | 165/133 |
| 109650 | 8/1979 | Japan | 165/104.27 |
| 74492 | 4/1984 | Japan | 165/104.27 |
| 191191 | 9/1985 | Japan | 165/104.27 |

OTHER PUBLICATIONS

P. Dunn et al., "Heat Pipes", 2nd Ed., Pergamom Press, G.B., 1978, pp. 113–126.

*Primary Examiner*—Albert W. Davis, Jr.
*Attorney, Agent, or Firm*—Barnes & Thornburg

[57] ABSTRACT

A heat pipe of aluminum is provided on the inside on all sides thereof with a completely closed fluid-tight coating of a water-resistant nickel in order to make the same resistant against water as heat carrier medium or to make the same vacuum-tight for long periods of time. Also, a coating of hard solder material is possible. The coating thickness is no less than 10 μm and no more than 15 μm. Individual parts of the heat pipe, prior to the soldering, are coated with the nickel material, each by itself, completely up to the joint areas. A process of making the heat pipe is also provided.

25 Claims, 3 Drawing Sheets

HEAT PIPE OF ALUMINUM, STEEL OR GRAY CAST IRON

BACKGROUND AND SUMMARY OF THE INVENTION

This is a continuation-in-part of Ser. No. 773,867, filed Sept. 9, 1985, now abandoned.

The present invention relates to a heat pipe of aluminum.

Heat pipes are known, as such, in many applications, and, in particular also with the use of the materials of aluminum or steel, especially stainless steel. In particular, aluminum offers special advantages because, on the one hand, it has good heat-conducting properties and the one hand, it can be pressed also into complicated shapes and easily machined. In this connection, the extrusion profiles with peeled or stripped-off heat-transfer ribs or the expanded partial composite laminated bodies should be mentioned as semi-finished articles made of aluminum which can be manufactured in a price-favorable manner and represent good starting products for heat pipes.

Though aluminum is normally corrosion-resistent against water, this is so only as long as a closed aluminum oxide layer is present. By reason of the brittleness of this layer, however, hair cracks or crevices occur during thermal loads of heat pipes so that water, for all practical purposes, can have direct access to the aluminum and form with the same an hyroxide. For that reason as heat carrier medium, the aluminum heat pipe corrodes at least in very minute places after a few operating hours so that the vacuum in the interior of the heat pipe collapses and the effectiveness thereof is lost.

Accordingly, heat pipes made of the aforementioned materials have been used only with other liquids as heat carrier medium. In particular, fluoro-hydrocarbons were used which, however, are relatively expensive and with which the thermal efficiency of the heat pipe is considerably lower than with the use of water.

It is the object of the present invention to construct heat pipes of aluminum, in such a manner that they are able to serve unimpaired over long periods of time without any problem or that they can be operated with water as heat carrier medium without time limitation and without efficiency loss.

The underlying problems are solved according to the present invention in that the aluminum heat pipe is provided on the inside thereof on all sides with a completely closed fluid-tight coating of water-resistant nickel and is filled with water as heat carrier medium. Due to the complete inner coating of nickel, which is free of micro-pores and free of cracks, the aluminum heat pipe, becomes resistant to water, whereby, however, it must be assured that the coating does not have a crack or pore at a single place of the interior surface; in particular within the seam area of joint parts of the heat pipe, the coating must extend uninterruptedly and free of any damages. As a result thereof, castings become completely vacuum tight.

Other coatings inert with respect to water such as copper are not suitable when used to coat an aluminum workpiece with the required wall thickness. Nickel, due to a different separating method, can be precipitated on aluminum in the required layer thickness without pores and cracks.

A coating of the order of magnitude of at least 10 μm and no more than 15 μm is necessary. The lower limit of the layer thickness must be observed to assure the nickel coating is non-porous. The upper limit of the layer thickness must not be exceeded to provide sufficient thermal flexibility and to prevent cracks.

The described coating fulfills all of the following requirements: with the present-day known plating methods, nickel can be thermally initimately combined together with good heat conduction with the base material of aluminum so that an only very small temperature jump occurs at the transition place to the base material. Additionally, these materials can be applied pore-tight (nonporous) and vacuum-proof. Also very thin coatings of the aforementioned order of magnitudes are possible, as a result of which only a very small temperature drop occurs by reason of the wall thickness increase. The coating itself is elastic and can partake without difficulties stress-free and crack-free in the unavoidable temperature expansions of the aluminum. Also complicated interior shapes can be coated in this manner without difficulty and corresponding to the described requirements. Further, nickel is resistant against water in the operation as heat pipe and is well-wettable by water. Additionally, the coating nickel is compatible with the aluminum base material and does not form any corrosively acting elements with the same.

In another advantageous embodiment of the invention, the nickel used for the coating contains 12–15% phosphorous. The phosphorous faciliates keeping the metal coating sufficiently dense with respect to pores and sufficiently flexible with respect to occurring thermal expansions.

In another advantageous embodiment of the invention, the nickel is separated electrochemically during a flow-through of a corresponding separating fluid through the heating pipe.

In other preferred embodiments of the invention, the heat pipe can be made of steel or gray cast iron in addition to aluminum. With respect to steel, the same problem of lack of resistance to water exists as with aluminum. Further, so-called stainless steel is not resistant and lasting in the use as a heat pipe and with water as heat carrier medium because a thermal de-oxidation takes place continuously in the evaporating zone of the heat pipe and thus a lack of oxygen prevails for the formation of a passivating layer. Heat pipes of stainless steel are also corroded after a relatively short period of time during the operation with water as heat carrier medium.

With respect to gray cast iron, the texture or structure of the casting is not sufficiently vacuum-proof in order to be able to maintain the heat pipe process over long periods of time. The causes therefor are not clear; however, micro-cracks and crevices are suspected.

As with the aluminum pipes discussed above, these problems are solved by providing an inside coating of water-resistant metal which can include nickel as discussed above or copper. With this coating, one can completely do away even with the expensive stainless steel and the more inexpensive normal steel can be used insofar as this is permitted depending on the application conditions of the heat pipe.

These and other objects, features and advantages of the present invention will become more apparent from the following description when taken in connection with the accompanying drawing which shows, for purposes of illustration only, several embodiments in accordance with the present invention, and wherein:

DETAILED DESCRIPTION OF THE DRAWINGS

Figure 1:
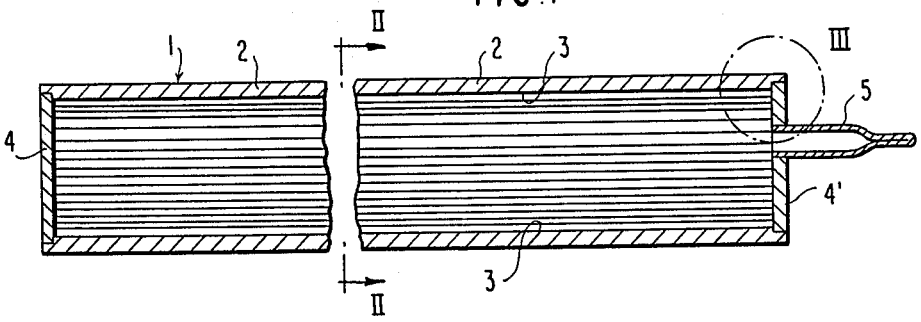
FIG. 1 is a longitudinal cross-sectional view through a heat pipe in accordance with the present invention.
Figure 2:
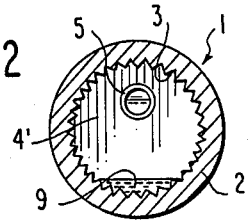
FIG. 2 is a transverse cross-sectional view through the heat pipe of FIG. 1, taken along line II—II of FIG. 1.

Referring now to the drawing wherein like reference numerals are used throughout the various views to designate like parts, the heat pipe generally designated by reference numeral 1 which is illustrated in FIGS. 1 and 2, essentially consists of a pipe element 2 of aluminum made by extrusion which has a capillary structure 3 on the inside thereof created by longitudinal grooves. The ends of the pipe element 2 are closed-off by soldered-on or brazed-on end caps 4, respectively, 4', whereby a filling tubule 5 is additionally soldered or brazed into the end cap 4'. The interior of the heat pipe is evacuated by way of this filling tubule 5. At the same time, the heat carrier medium is injected through the same. Subsequently, the filling tubule 5 is squeezed off and hermetically welded together.

Figure 3:
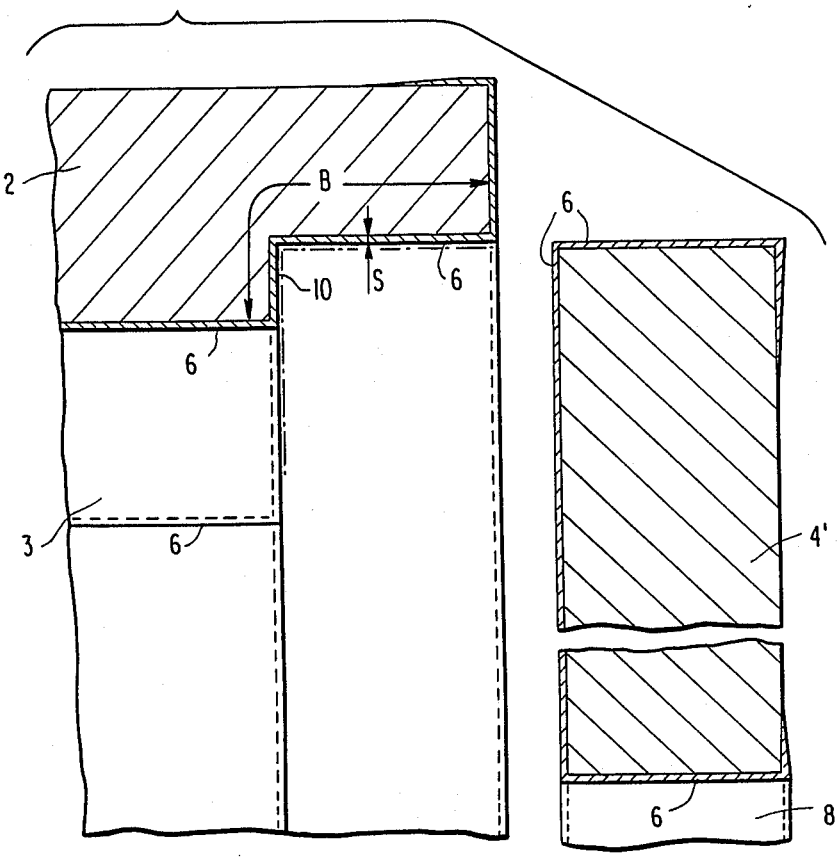
FIG. 3 is a partial cross-sectional view, on an enlarged scale, illustrating the detail in the dash-and-dot circle III of FIG. 1 prior to soldering together the individual parts.
Figure 4:
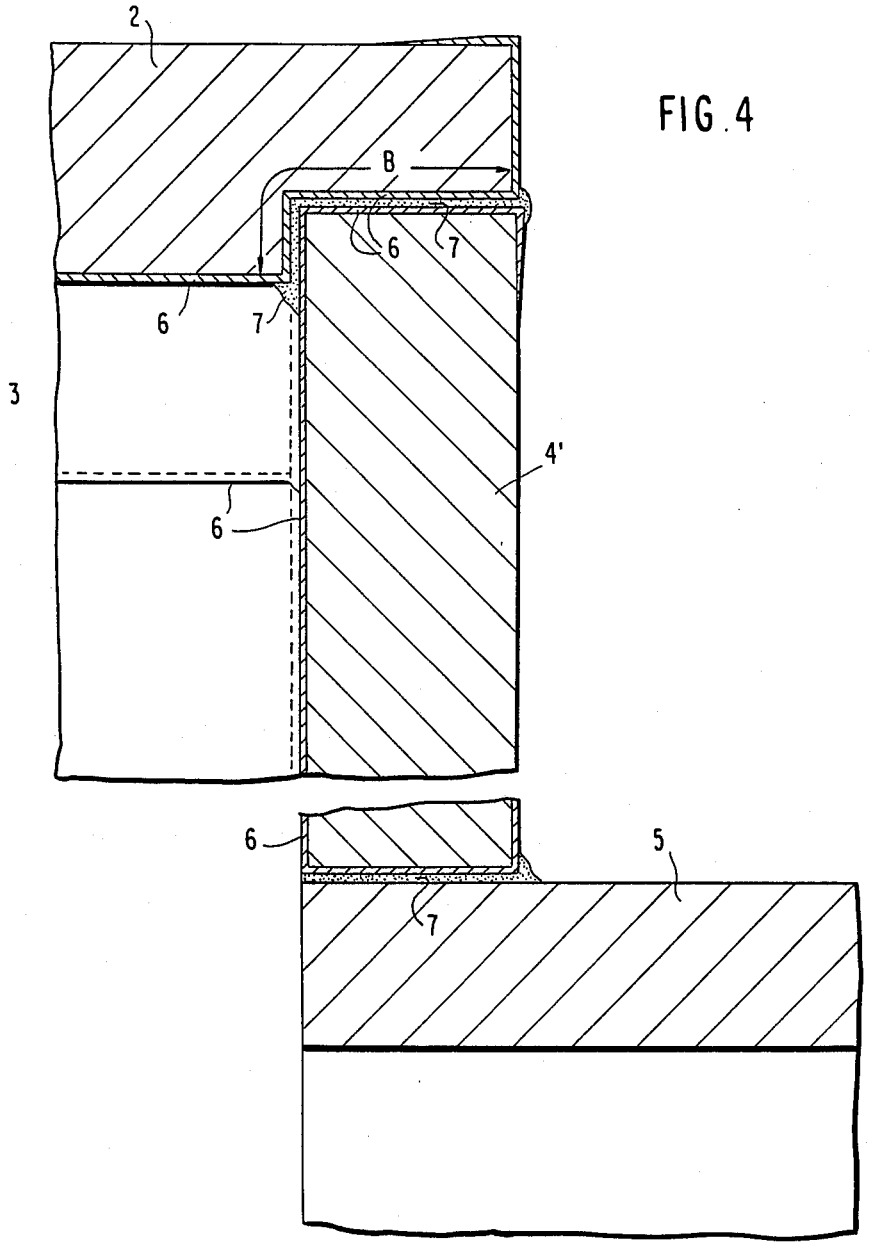
FIG. 4 is a partial cross-sectional view, similar to FIG. 2, but showing the parts of the soldered-together condition.

As shown in the enlarged illustrations according to FIGS. 3 and 4, the interior of the heat pipe is provided on all sides with a completely closed, fluid-tight coating 6 of a water-resistant nickel. The coating thickness s should be no less than 10 μm and no more than 15 μm, preferably in order to assure, on the one hand, a sufficiently large coating thickness for a pore-free coating and, on the other, to account for thermal flexibility, to prevent cracks, and to increase as little as possible the wall thickness and the weight of the heat pipe.

The coating can be applied chemically or galvanically in any known manner. Also, pressure plating or solder plating with the use of correspondingly formed thin metal foils is possible. In particular with the solder plating, one will also use a hard solder material as coating material which is suitable also without any difficulty.

In a further embodiment, the nickel coating material contains 12–15% phosphorous in order to keep the metal coating sufficiently dense with respect to pores and sufficiently flexible with respect to occurring thermal expansions. The nickel is separated electrochemically during the flow-through of a corresponding separating fluid through the heating pipe In order to assure that the coating extends pore-free also into the area of the solder (brazed) joints, the individual parts of the heat pipe which are to be soldered or brazed together are provided with the coating each for itself completely up to into the area of the solder joint 10, as is shown more clearly in particular in FIG. 3. It is appropriate to permit the coating to extend over the entire width B of the solder joint in order to assure that in case the solder 7 itself does not completely fill out the solder joint 10, the surface of the joint wettable from the inside is nonetheless provided with a coating 6. More particularly, the individual parts of the heat pipe are provided with the coating after their mechanical machining for the tolerance-accurate fitting of the individual parts so that the coating is not partially removed by a material-removing machining operation.

Not only the pipe member 2 of the heat pipe is provided in this manner with the coating 6 but, for example, also the end caps 4 and 4'. For example, also the end cap 4' carrying the fill-in tubule 5 is provided with a coating 6 within the area of the bore 8 for the fill-in tubule. One might dispense with such a coating of the end cap if the same consisted completely of copper or nickel.

Since for the most part a small copper pipe is used for the fill-in tubule 5, the latter does not need to be coated with a corresponding material which is appropriate also for such small parts.

Though FIGS. 1 and 2 illustrate only a heat pipe of circular shape made by the extrusion method, also completely differently constructed heat pipe shapes are feasible, be it as extrusion profiles, as expanded partial composite laminate bodies or the like. For example, rectangularly shaped extrusion profiles are quite frequently used which are provided with longitudinally extending intermediate webs for the purpose of reinforcement. Cooling ribs applied by the peeling or stripping-off method may be provided on the outside. With such rectangularly shaped heat pipes, the end caps represent merely narrow metal strips which may be formed directly of copper so that a separate coating may be dispensed with in this case. With the expanded partial composite laminate bodies, end caps are dispensed with; in this case, only a fill-in tubule is necessary which, as mentioned, may also be formed of copper.

Figure 6:
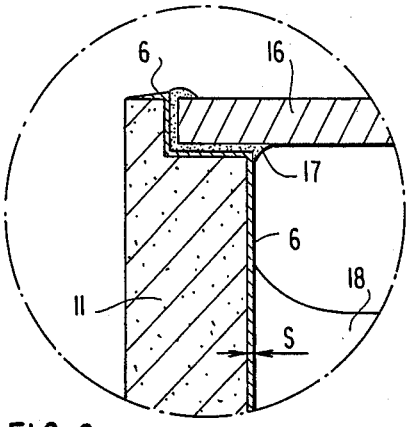
FIG. 6 is an enlarged view of the dash-dot circular portion of FIG. 5.
Figure 5:
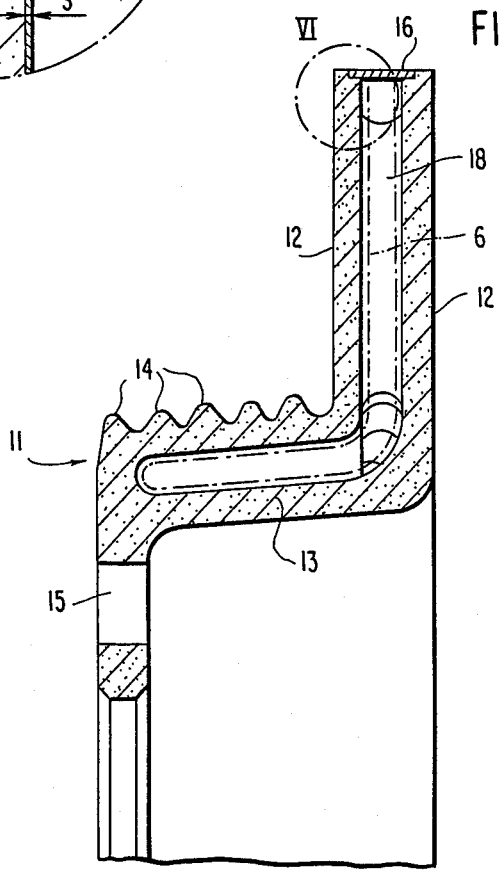
FIG. 5 is a partial cross-sectional view through a brake disk made of gray cast iron constructed as heat pipe in accordance with the present invention.

FIGS. 5 and 6 illustrate in cross section a brake disk generally designed by reference numeral 11 which is constructed as casting made from gray cast iron. More particularly, gray cast iron is selected because of its proven good slide properties within the area of the brake surfaces 12. The brake disk has essentially a hat-shape with a disk part carrying the brake surfaces 12, a hub 13 and a hub flange 15. The disk part and the hub are constructed hollow; however, the walls of the two mutually oppositely disposed brake surfaces are mutually reinforced against axial pressure forces of the brake calipers by support ribs. Cooling ribs 14 for the removal of the heat are provided at the outer circumference of the hub 13. In order to be able to form the hollow space in the disk part and in the hub, the disk part of the casting blank is open along the circumference in order to be able to support thereat a sand core. This slot-shaped circumferential opening is closed off vacuum-tight by a soldered-on or brazed-on closure bandage. As can be seen from the enlarged detail view, the interior of the hollow space of the brake disk is provided with a coating 6 that extends pore-free over the entire surface of the hollow space up to into the soldering gap--solder 17. The thickness s of the coating is selected so large that unevennesses and micro-cracks of the casting structure are reliably and permanently covered therewith and closed off thereby. The metallic coating material is selected in such a manner that it can be applied galvanically or electro-chemically, for example, of copper, nickel or chrome. Also, a multi-layer structure of the coating is feasible. By the introduction of spoke-like special electrodes into the hollow space of the brake disk which is initially still open at the outer circumference, the hollow space can be galvanically coated uniformly on all sides. The selection of the heat carrier medium depends functionally from the temperature level at which the heat pipe is to be operated. Since brake disks can withstand very high temperatures during the operation, metallic sodium is a suitable heat carrier medium which evaporates within the area of the brake surfaces 12 and again condenses within the area of the cooled hub. Owing to the centrifugal force influence, the liquid sodium again returns into the hot area of the brake surfaces where it evaporates anew.

While we have shown and described several embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

What is claimed:

1. Evacuated heat pipe comprising an aluminum pipe;

a fluid tight coating of nickel provided on the inside of all sides of the pipe, said coating having a thickness of between 10 μm and 15 μm; and said pipe is fractionally filled with water as a heat carrier medium.

2. Heat pipe as in claim 1, wherein the nickel coating includes 12–15% phosphorous.

3. Heat pipe as in claim 1, wherein the nickel is separated electrochemically during a flow-through of a separating fluid through the heating pipe.

4. Heat pipe as in claim 1, wherein the nickel coating consists of hard solder material.

5. Heat pipe as in claim 1, wherein the pipe includes individual soldered-together parts, said parts having solder joints therebetween, said parts being coated with nickel prior to being soldered together, and said coating extending completely up to into the area of the solder joint.

6. Heat pipe as in claim 5, wherein the solder joint has a width area and the coating extends over the entire width of the solde joint.

7. Heat pipe as in claim 5, wherein in at least one of the parts of the heat pipe consists completely of a water-resistant metal.

8. Heat pipe as in claim 7, wherein said at least one part consists of copper.

9. Heat pipe as in claim 5, wherein the coating consists of a hard solder material.

10. Heat pipe as in claim 1, further including a multilayer structure of coating including a copper coating over the coating of nickel.

11. An evacuated heat pipe made of aluminum, steel or gray cast iron which is fractionally filled with a liquid heat carrier medium, in which the heat pipe is provided on the inside of all sides thereof with a completely closed, fluid-tight coating of a water-resistant metal and is filled with water as heat carrier medium, wherein said heat pipe includes individual soldered-together parts, having solder joints therebetween, at least one of said parts being coated with the water-resistant metal, said coating substantially covering the area of the solder joint.

12. Heat pipe as in claim 11, wherein the coating consists of one of copper, nickel and alloys thereof.

13. Heat pipe as in claim 11, wherein the coating consists of a hard solder material.

14. Heat pipe as in claim 11, wherein the solder joint has a width area and the coating extends over the entire width of the solder joint.

15. Heat pipe as in claim 11, wherein in at least one of the parts of the heat pipe consists completely of water-resistant metal.

16. Heat pipe as in claim 15, wherein said at least one part consists of copper.

17. A heat pipe comprising a pipe which is evacuated and fractionally filled with a liquid heat carrier medium, wherein the heat pipe consists of gray cast iron and is provided inside on all sides thereof with a completely closed fluid-tight metallic coating.

18. A heat pipe according to claim 17, wherein the coating consists of copper, nickel or alloys thereof.

19. Process for making evacuated heat pipe comprising:

applying a fluid tight coating of nickel to the inside of all sides of an aluminum pipe, said coating having a thickness of between 10 μm and 15 μm; and functionally filling said coated pipe with water as a heat carrier medium.

20. Process as in claim 18, wherein the nickel coating includes 12–15% phosphorous in said nickel.

21. Process as in claim 19, wherein the nickel is separated electrochemically during a flow-through of a separating fluid through the heating pipe.

22. Process as in claim 19, wherein the coating includes hard solder material.

23. Process as in claim 19, wherein the coating application includes pipes having individual soldered-together parts, said parts having solder joints therebetween, said parts being coated with nickel prior to being soldered together, and said coating extending completely up to into the area of the solder joint.

24. Process for making evacuated heat pipe comprising:

applying a fluid tight coating of water-resistent metal to the inside surface of a pipe made of one of the following aluminum, steel and gray cast iron, wherein said heat pipe includes individual soldered-together parts, having solder joints therebetween, at least one of the said parts being coated with the water-resistant metal, said coating substantially covering the area of the solder joint; and fractionally filling said coated pipe with water as a heat carrier medium.

25. Process as in claim 24, wherein said coating applying includes a coating of one of the following: copper, nickel and alloys thereof.

* * * * *